US007806655B2

(12) United States Patent
Gagne et al.

(10) Patent No.: US 7,806,655 B2
(45) Date of Patent: Oct. 5, 2010

(54) METHOD AND APPARATUS FOR ASSEMBLING BLADE SHIMS

(75) Inventors: Lynn Charles Gagne, Simpsonville, SC (US); Graham David Sherlock, Greenville, SC (US); Kelvin Aaron, Simpsonville, SC (US); Thomas Robbins Tipton, Greer, SC (US)

(73) Assignee: General Electric Company, Schenectady, NY (US)

( * ) Notice: Subject to any disclaimer, the term of this patent is extended or adjusted under 35 U.S.C. 154(b) by 860 days.

(21) Appl. No.: 11/679,468

(22) Filed: Feb. 27, 2007

(65) Prior Publication Data

US 2008/0206063 A1 Aug. 28, 2008

(51) Int. Cl.
*F01D 9/04* (2006.01)

(52) U.S. Cl. ..... 415/209.3; 416/220 R; 416/248

(58) Field of Classification Search ..... 415/209.1, 415/209.3, 209.4, 219 R, 220 R, 221, 215, 415/248; 416/219 R, 220 R, 221, 215, 248
See application file for complete search history.

(56) References Cited

U.S. PATENT DOCUMENTS 4,772,167 A * 9/1988 Beals ..... 411/43
4,901,523 A 2/1990 Huelster
5,063,661 A 11/1991 Lindsay
5,160,243 A 11/1992 Herzner et al.
5,240,375 A 8/1993 Wayte
5,333,995 A 8/1994 Jacobs et al.
6,202,273 B1 3/2001 Watts
6,290,466 B1 9/2001 Ravenhall et al.
6,398,499 B1 6/2002 Simonetti et al.
6,412,161 B2 7/2002 Watts
6,431,835 B1 8/2002 Kolodziej et al.
6,792,691 B2 9/2004 Genal et al.
6,860,722 B2 3/2005 Forrester et al.
6,984,108 B2 1/2006 Anderson et al.
2005/0191177 A1 9/2005 Anderson et al.

* cited by examiner

*Primary Examiner*—Edward Look
*Assistant Examiner*—Dwayne J White
(74) *Attorney, Agent, or Firm*—Armstrong Teasdale LLP

(57) ABSTRACT

A method for assembling a stator assembly for a turbine engine is provided. The method includes providing a blade with a base including an end wall having at least one hole defined therein and providing a shim having at least one aperture extending therethrough. The shim aperture is aligned with the end wall hole, and the shim is secured to the blade base end wall using a fastener. The fastener is inserted through the shim aperture in an interference fit within the end wall hole. The blade and the shim are coupled to a turbine casing.

17 Claims, 6 Drawing Sheets

METHOD AND APPARATUS FOR ASSEMBLING BLADE SHIMS

BACKGROUND OF THE INVENTION

This invention relates generally to gas turbine engines, and, more specifically, a blade assembly for a gas turbine engine.

Some known turbines include a compressor that compresses fluid and channels the compressed fluid towards a turbine wherein energy is extracted from the fluid flow. Some known compressors include a row of blades secured to the compressor casing. Such blades may be secured to the casing using flanges on the base of the blade that are inserted into grooves defined in the casing. More specifically, in at least some known embodiments, the casing includes T-shaped grooves for each row of blades, and the blade flanges are sized and shaped to fit within the T-shaped groove.

During operation, some blades in the compressor may loosen in the grooves and shift with respect to each other and with respect to the compressor casing. Such movement may increase the turbine dynamics and may increase the wear of the blade. The movement of the blades may also induce stresses to the blade, which, over time, cause cracking or failure of the blade.

To reduce blade movement, some known compressor blades are shimmed to decrease the clearance between turbine blade bases and to limit movement of the blade within the casing. Some known shims are formed with tabs extending from each side to enable the shim to be secured in position against the casing. In at least some compressors, the tabs fit into the same grooves used to retain the blades within the casing. During turbine operation, some known shims may be chafed by the adjacent blade bases causing the shim to thin. As the shim wears, the clearance defined between the blade and the shim, or between the blade and the groove, is increased. Over time, the increased clearance enables the blades to move within the casing groove.

In some known turbines, during turbine operation, the pressure and loading on each blade and shim may fluctuate. Variations in loading induced to the blades and/or shims may cause wear of the shim tabs. Over time, the wear to the tabs may loosen the shim from the casing such that the shim may protrude into the fluid flow path and/or fall into the flow stream. Any shim protruding into the flow stream may disrupt the flow stream and/or decrease turbine operating efficiency. Any shim falling into the flow stream may contact other compressor components, such as the blades, which may damage such components.

BRIEF DESCRIPTION OF THE INVENTION

In one aspect a method for assembling a stator assembly for a turbine engine is provided. The method includes providing a blade with a base including an end wall having at least one hole defined therein and providing a shim having at lease one aperture extending therethrough. The shim aperture is aligned with the end wall hole, and the shim is secured to the blade base end wall using a fastener. The fastener is inserted through the shim aperture in an interference fit within the end wall hole. The blade and the shim are coupled to a turbine casing.

In another aspect a gas turbine engine is provided. The gas turbine engine includes a compressor and a stator assembly. The stator assembly includes a blade having a base comprising at least one hole defined therein and a shim comprising at least one aperture extending therethrough. A fastener is configured to secure the shim to the blade base such that the aperture is substantially concentrically aligned with the base hole. The fastener is inserted through the shim aperture and is interference fit in the base hole.

In a further aspect a blade assembly for use with a turbine is provided. The blade assembly includes a base including an end wall. At least one hole is defined in the end wall. A shim including at least one aperture defined therethrough. The aperture is substantially concentrically aligned with at least one end wall hole. The blade assembly further includes a rivet inserted through at least one shim aperture and interference fit in at least one end wall hole.

DETAILED DESCRIPTION OF THE INVENTION

Figure 1:
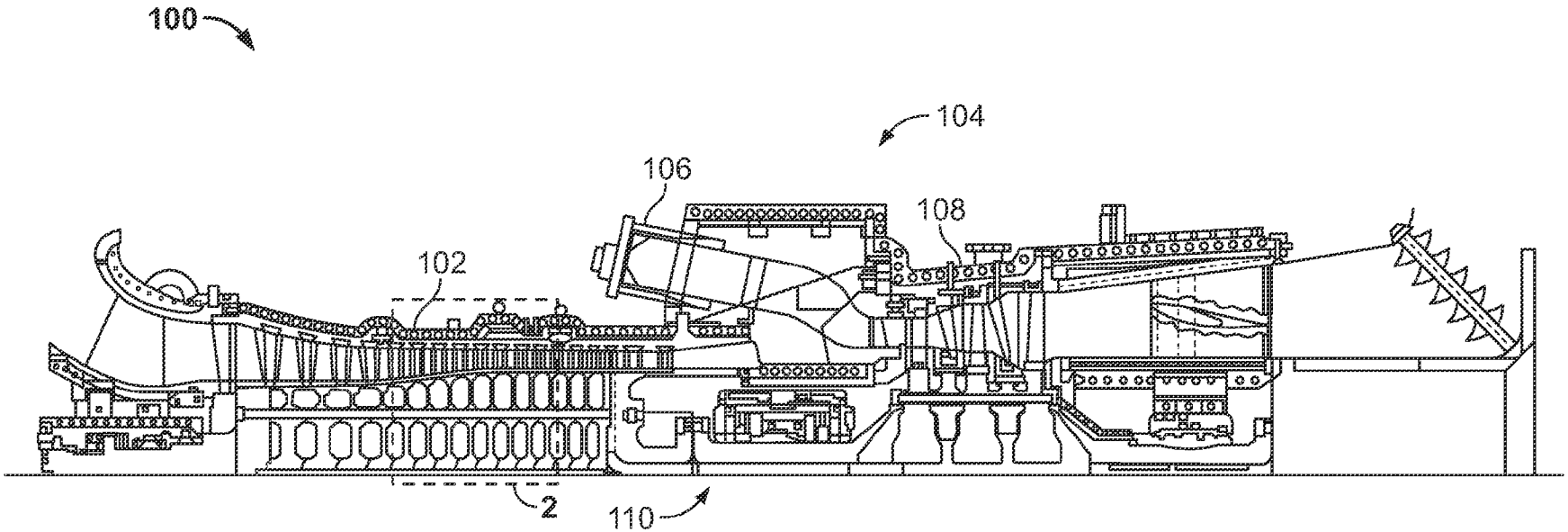
FIG. 1 is a schematic view of an exemplary gas turbine engine.

FIG. 1 is a schematic illustration of an exemplary gas turbine engine 100. Engine 100 includes a compressor 102 and a plurality of combustors 104. Combustor 104 includes a fuel nozzle assembly 106. Engine 100 also includes a turbine 108 and a common compressor/turbine rotor 110 (sometimes referred to as rotor 110).

Figure 2:
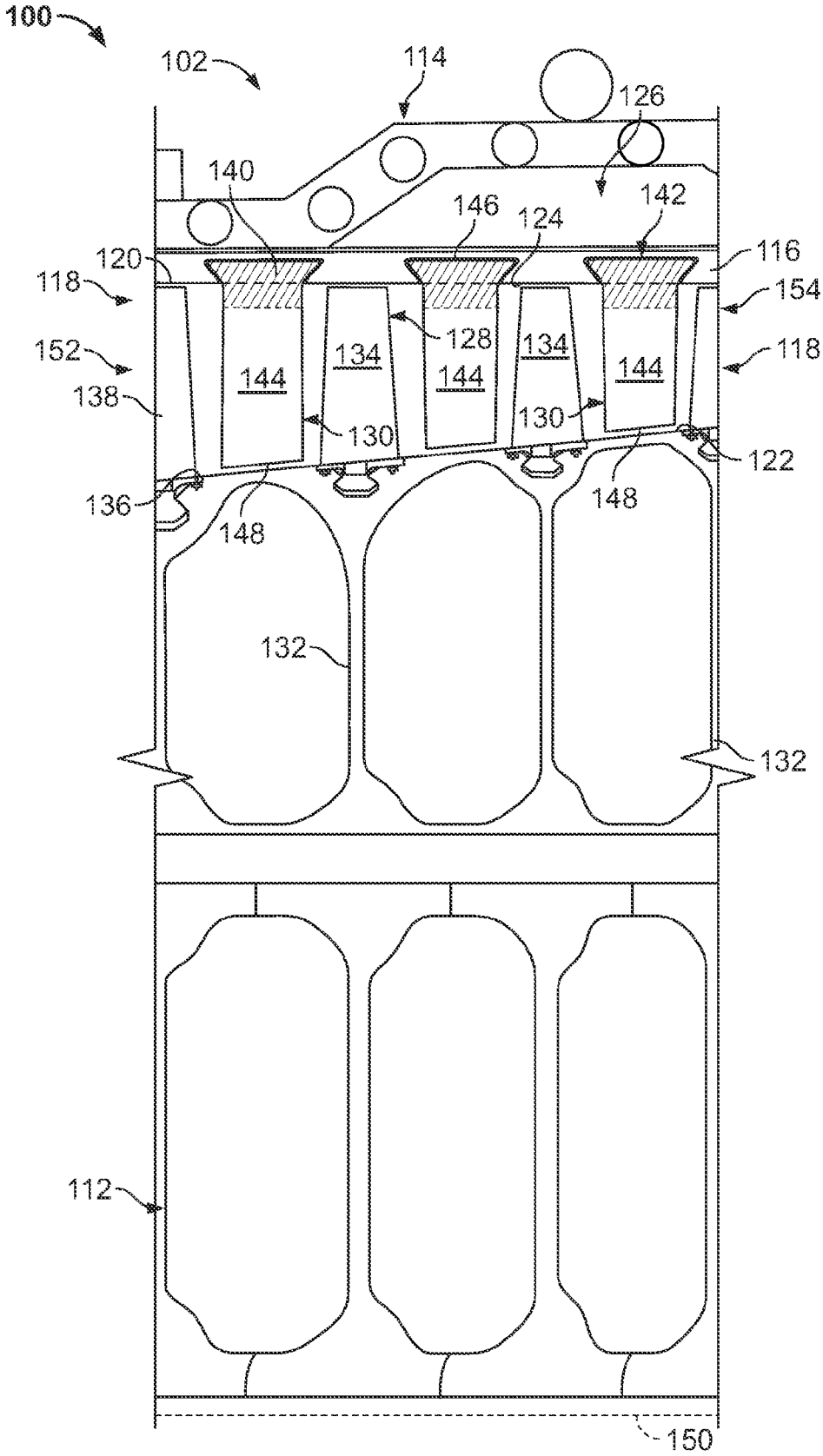
FIG. 2 is an enlarged cross-sectional view of a portion of an exemplary compressor that may be used with the gas turbine engine shown in FIG. 1 and taken along area 2.

FIG. 2 is an enlarged cross-sectional view of a portion of an exemplary compressor, such as compressor 102, used with gas turbine engine 100 and taken along area 2 (shown in FIG. 1). Compressor 102 includes a rotor assembly 112 and a stator assembly 114 that are positioned within a casing 116. Casing 116 partially defines a flow path 118 in conjunction with at least a portion of a radially inner surface 120 of casing 116. In the exemplary embodiment, rotor assembly 112 forms a portion of rotor 110 and is rotatably coupled to a turbine rotor (not shown). Rotor assembly 112 also partially defines an inner flow path boundary 122 of flow path 118, and stator assembly 114, in cooperation with inner surface 120, partially defines an outer flow path boundary 124 of flow path 118. Alternatively, stator assembly 114 and casing 116 are formed as a unitary and/or an integrated component.

Compressor 102 includes a plurality of stages 126. Each stage 126 includes a row of circumferentially-spaced rotor blade assemblies 128 and a row of stator blades 130, sometimes referred to as stator vanes. Rotor blade assemblies 128 are each coupled to a rotor disk 132 such that each blade assembly 128 extends radially outwardly from rotor disk 132. Moreover, each assembly 128 includes a rotor blade airfoil portion 134 that extends radially outward from an inner blade coupling apparatus 136 to a rotor blade tip portion 138. Compressor stages 126 cooperate with a motive or working fluid including, but not limited to, air, such that the motive fluid is compressed in succeeding stages 126.

Stator assembly 114 includes a plurality of rows of stator rings 140, sometimes referred to as stator-in-rings, stator support rings, and/or stator dovetail rings. Rings 140 are inserted into passages or channels 142 that are defined circumferentially in axial succession within a portion of casing 116. More specifically, in the exemplary embodiment, each channel 142 is defined within a portion of casing 116 that is radially outward from rotor blade tip portions 138. In the exemplary embodiment, channel 142 is a T-shaped channel with opposing grooves (not shown). Each stator ring 140 is sized and shaped to receive a plurality of rows of stator blades 130 such that each row of stator blades 130 is positioned between a pair of axially-adjacent rows of rotor blade assemblies 128. In the exemplary embodiment, each stator blade 130 includes an airfoil portion 144 that extends from a stator blade base portion 146 to a stator blade tip portion 148. Compressor 102 includes one row of stator blades 130 per stage 126, some of which are bleed stages (not shown). Moreover, in the exemplary embodiment, compressor 102 is substantially symmetrical about an axial centerline 150.

In operation, compressor 102 is rotated by turbine 108 via rotor 110. Fluid collected from a low pressure region 152, via a first stage of compressor 102, is channeled by rotor blade airfoil portions 134 towards airfoil portions 144 of stator blades 130. The fluid is at least partially compressed and a pressure of the fluid is at least partially increased as the fluid is channeled through the remainder of flow path 118. More specifically, the fluid continues to flow through subsequent compressor stages that are substantially similar to the first compressor stage 126 with the exception that flow path 118 narrows with successive stages to facilitate compressing and pressurizing the fluid as it is channeled through flow path 118. The compressed and pressurized fluid is subsequently channeled into a high pressure region 154 such that it may be used within turbine engine 100.

Figure 3:
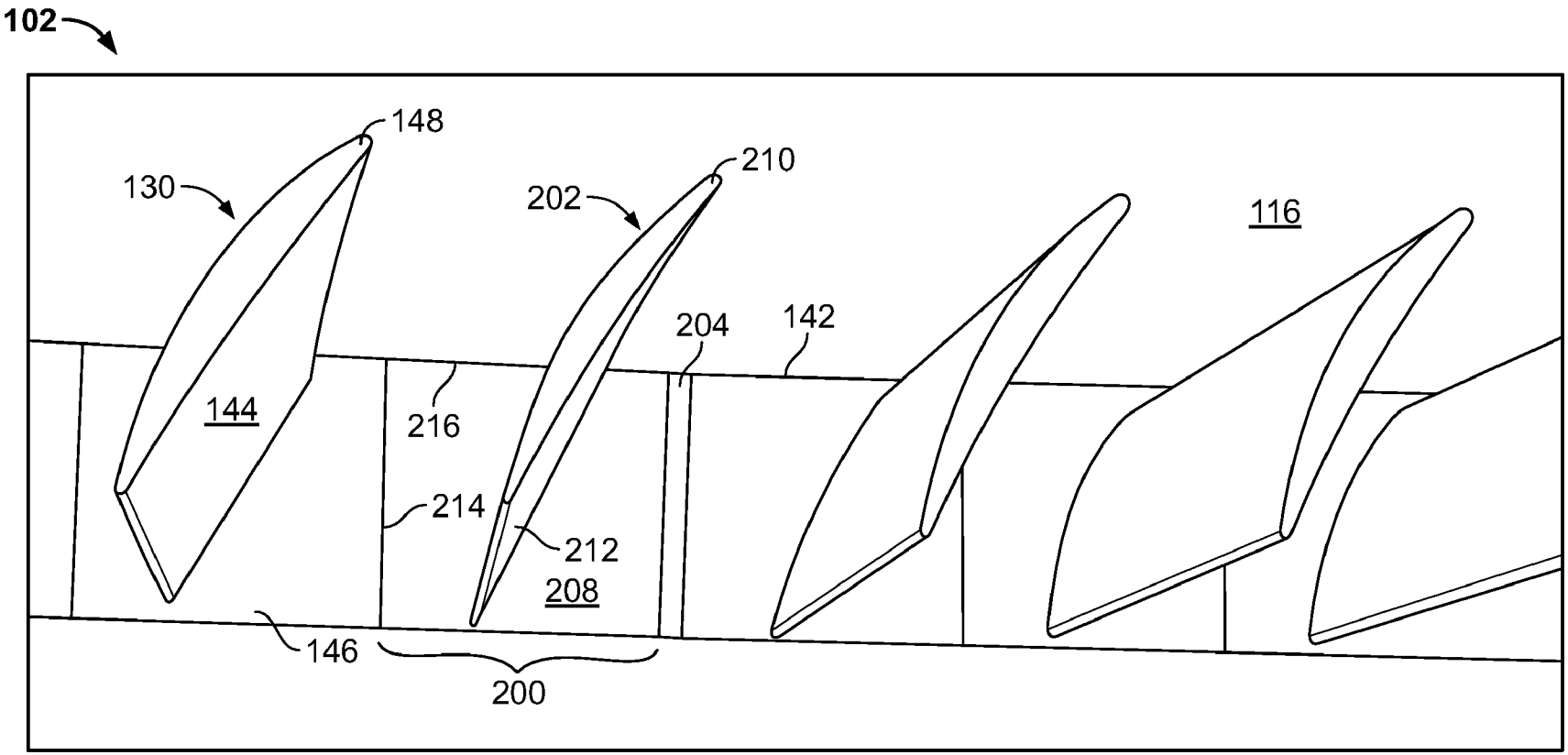
FIG. 3 is a perspective view of an exemplary row of stator blades that may be used with the gas turbine engine shown in FIG. 1.

FIG. 3 is a perspective view of an exemplary row of stator blades 130, including a blade assembly 200, which may be used with gas turbine engine 100. Compressor 102 includes one or more rows of blades 130. In the exemplary embodiment, each row of blades 130 is secured to the compressor by retaining each blade base 146 within a T-shaped channel 142 defined in compressor casing 116. In the exemplary embodiment, the row of blades 130 includes at least one blade assembly 200. More specifically, in the exemplary embodiment, blade assembly 200 includes a blade 202, a shim 204, and a rivet 206 (shown in FIG. 6-8), as described in more detail below. Shim 204 is positioned between adjacent blades 130 and 202 such that a clearance (not shown) defined between blades 130 and 202 is facilitated to be reduced.

Figure 4:
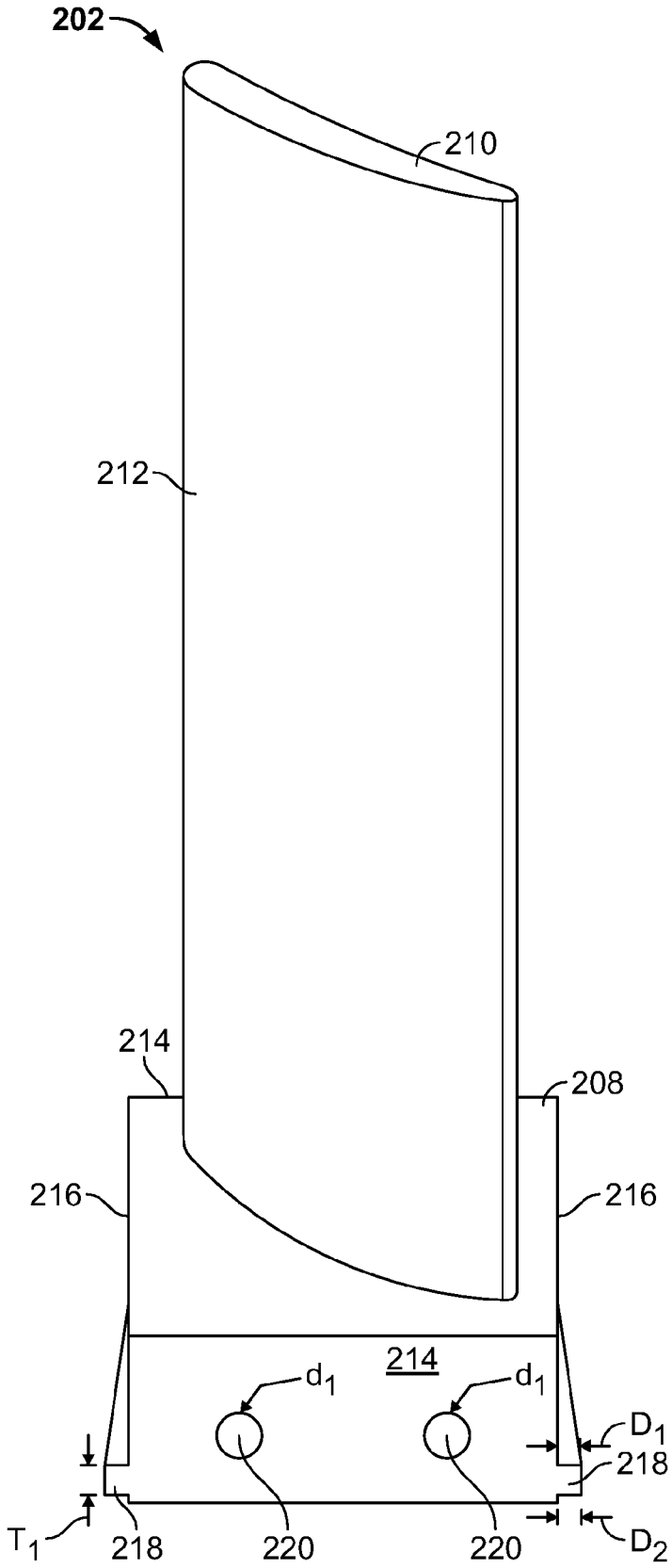
FIG. 4 is a perspective view of an exemplary blade that may be used with the row of stator blades shown in FIG. 3.

FIG. 4 is a perspective view of an exemplary blade 202 that may be used with blade assembly 200. Blade 202 is substantially similar to blade 130. Blade 202 includes a base 208 that is shaped substantially similar to base 146 and a tip 210 that is shaped substantially similar to tip 148. An airfoil 212 extends between base 208 and tip 210 and is shaped substantially similar to airfoil 144. Base 208 includes two end walls 214 and two side walls 216. In the exemplary embodiment, each side wall 216 includes a flange 218 extending therefrom. Each flange 218 is inserted within channel 142 to secure blade 202 to compressor casing 116. In the exemplary embodiment, flange 218 has a top depth $D_1$, a bottom depth $D_2$, a length, and a thickness $T_1$. More specifically, in the exemplary embodiment, depth $D_1$ is longer than depth $D_2$. Alternatively, depth $D_1$ is shorter than, or approximately equal to, depth $D_2$. Furthermore, in the exemplary embodiment, the flange length is measured from one base end wall 214 to the other base end wall 214. Alternatively, the flange length is measured along a portion of side wall 216. In another embodiment, the flange length is measured beyond at least one end wall 214. Moreover, in the exemplary embodiment, thickness $T_1$ is selected to enable base 208 to be received within a groove within channel 142.

Base 208 also includes at least one hole 220 defined in at least one end wall 214. In the exemplary embodiment, two holes 220 are defined in one end wall 214 when blade 202 is assembled in blade assembly 200, as described in more detail below. Alternatively, blade 202 may include more or less than two holes 220 defined therein. In the exemplary embodiment, each hole 220 is circular and has a diameter $d_1$ and a depth $D_3$ (shown in FIG. 8). Alternatively, each hole 220 may have different diameters and/or depths.

Figure 5:
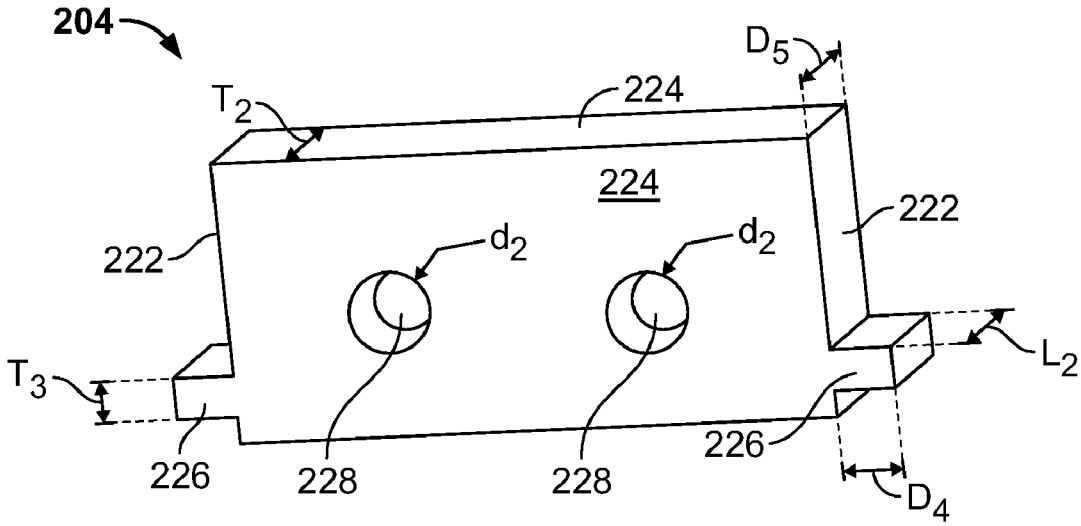
FIG. 5 is a perspective view of an exemplary shim that may be used with the blade shown in FIG. 4.

FIG. 5 is a perspective view of an exemplary shim 204 that may be used with blade assembly 200. In the exemplary embodiment, shim 204 has a thickness $T_2$ that is selected to facilitate reducing a clearance defined between blades 130 and 202, when blades 130 and 202 are assembled into a row within casing 116. Moreover, in the exemplary embodiment, shim 204 has two side walls 222 and two end faces 224. Each side wall 222 has a tab 226 extending outward therefrom to facilitate retaining shim 204 within casing channel 142. Each tab 226 has a top depth $D_4$, a bottom depth $D_5$, a length $L_2$, and a thickness $T_3$. Each tab 226 is aligned with each flange 218 when blade assembly 200 is fully assembled. More specifically, in the exemplary embodiment, depth $D_4$ is substantially equal to depth $D_1$, and depth $D_5$ is substantially equal to depth $D_2$. Alternatively, depths $D_4$ and $D_5$ are different from depths $D_1$ and $D_2$, respectively.

Furthermore, in the exemplary embodiment, length $L_2$ is measured along side wall 222 from one end face 224 to the other end face 224. Alternatively, length $L_2$ extends partially along side wall 222. In another embodiment, length $L_2$ extends beyond at least one end face 224. In the exemplary embodiment, thickness $T_3$ is selected to enable tab 226 to be positioned within a groove (not shown) in channel 142 such that shim 204 is secured to casing 116.

Shim 204 includes at least one aperture 228 defined therethrough. More specifically, in the exemplary embodiment, shim 204 includes two apertures 228 defined therethrough. Alternatively, shim may have more or less than two apertures 228, depending on the number of holes 220 defined in blade 202. Alternatively, shim 204 may includes more or less apertures 228 than the number of holes 220. In the exemplary embodiment, apertures 228 extend from one end face 224, through shim 204, to the other end face 224. Furthermore, in the exemplary embodiment, each aperture 228 is substantially aligned with each hole 220 when blade assembly 200 is fully assembled. In the exemplary embodiment, each aperture 228 is circular and has the same diameter $d_2$. Alternatively, each aperture 228 may have different diameters. In the exemplary embodiment, aperture diameter $d_2$ is greater than diameter $d_1$. Alternatively, diameter $d_2$ may be approximately equal to, or smaller than, diameter $d_1$.

Figure 6:
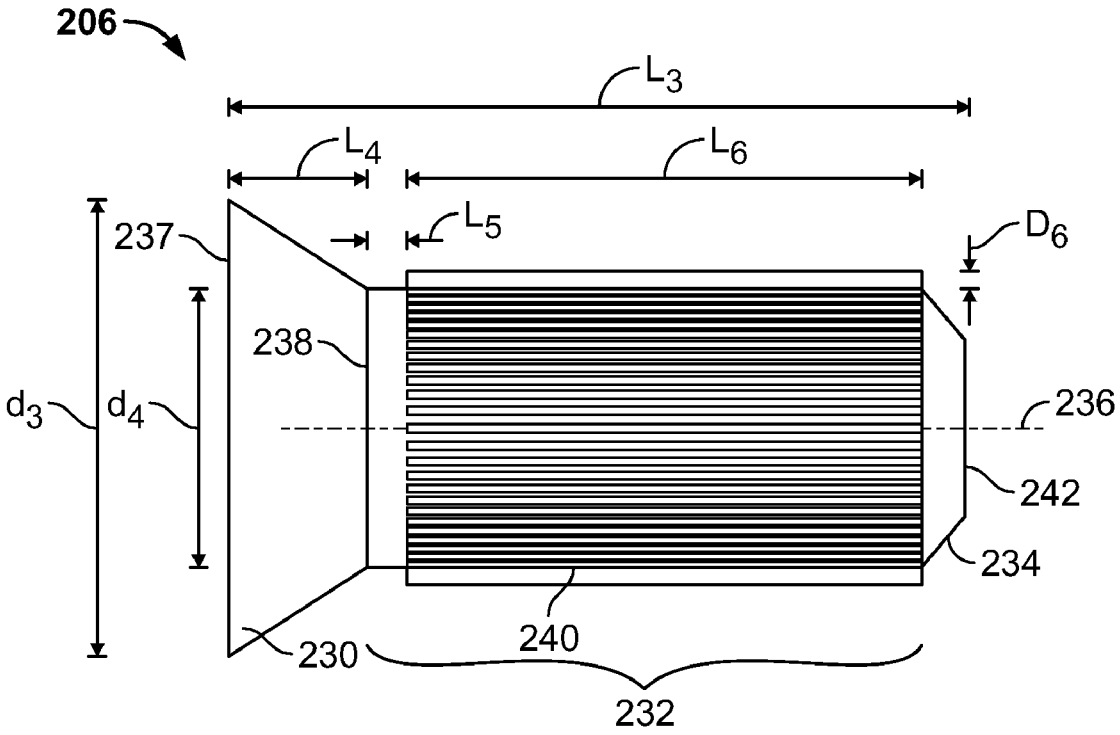
FIG. 6 is a side view of an exemplary rivet that may be used with the blade shown in FIG. 4.

FIG. 6 is a side view of an exemplary rivet 206 that may be used with blade assembly 200. Rivet 206 includes a head 230, a body 232, and an end portion 234. Rivet 206 has a length $L_3$ that in the exemplary embodiment, is shorter than hole depth $D_3$. Alternatively, length $L_3$ may be approximately equal to, or longer than, depth $D_3$. Rivet 206 is symmetric about a centerline 236. In the exemplary embodiment, head 230 is circular and has a diameter $d_3$. More specifically, a top 237 of head 230 is formed with the widest diameter $d_3$. In the exemplary embodiment, diameter $d_3$ is substantially equal to diameter $d_2$. Alternatively, diameter $d_3$ may be wider or narrower than diameter $d_2$. Head 230 has a length $L_4$ that extends between head top 237 to a base 238 of head 230. In the exemplary embodiment, head diameter $d_3$ decreases along length $L_4$ such that the widest diameter $d_3$ is at top 237 and the narrowest diameter $d_3$ is defined at base 238. In the exemplary embodiment, body 232 is circular and is formed with a diameter $d_4$. In the exemplary embodiment, diameter $d_4$ is narrower than diameter $d_3$. Alternatively, diameter $d_4$ is approximately equal to, or wider than, diameter $d_3$. Furthermore, in the exemplary embodiment, diameter $d_4$ is approximately equal to, or narrower than, hole diameter $d_1$.

In the exemplary embodiment, body 232 includes collapsible knurls 240 formed at a length $L_5$ from base 238. In an alternative embodiment, knurls 240 are formed at base 238. Alternatively, body 232 may include a collapsible, raised surface other than knurls 240. In the exemplary embodiment, knurls 240 each have a depth $D_6$. More specifically, depth $D_6$ is selected to create an interference fit between rivet 206 and base hole 220. Each knurl 240 has a length $L_6$. In the exemplary embodiment, length $L_6$ is measured between an end of length $L_5$ and end portion 234. Alternatively, length $L_6$ may be measured to a point (not shown) before end portion 234 begins, or length $L_6$ may be measured into end portion 234. In the exemplary embodiment, knurls 240 are configured to be collapsible to form an interference fit.

In the exemplary embodiment, end portion 234 tapers from body 232 to an end 242. End portion 234 may be frustoconical. Alternatively, end portion 234 may terminate in an apex (not shown), a dome (not shown), a non-tapered end (not shown), or any other suitable configuration that enables rivet 206 to function as described herein.

Figure 7:
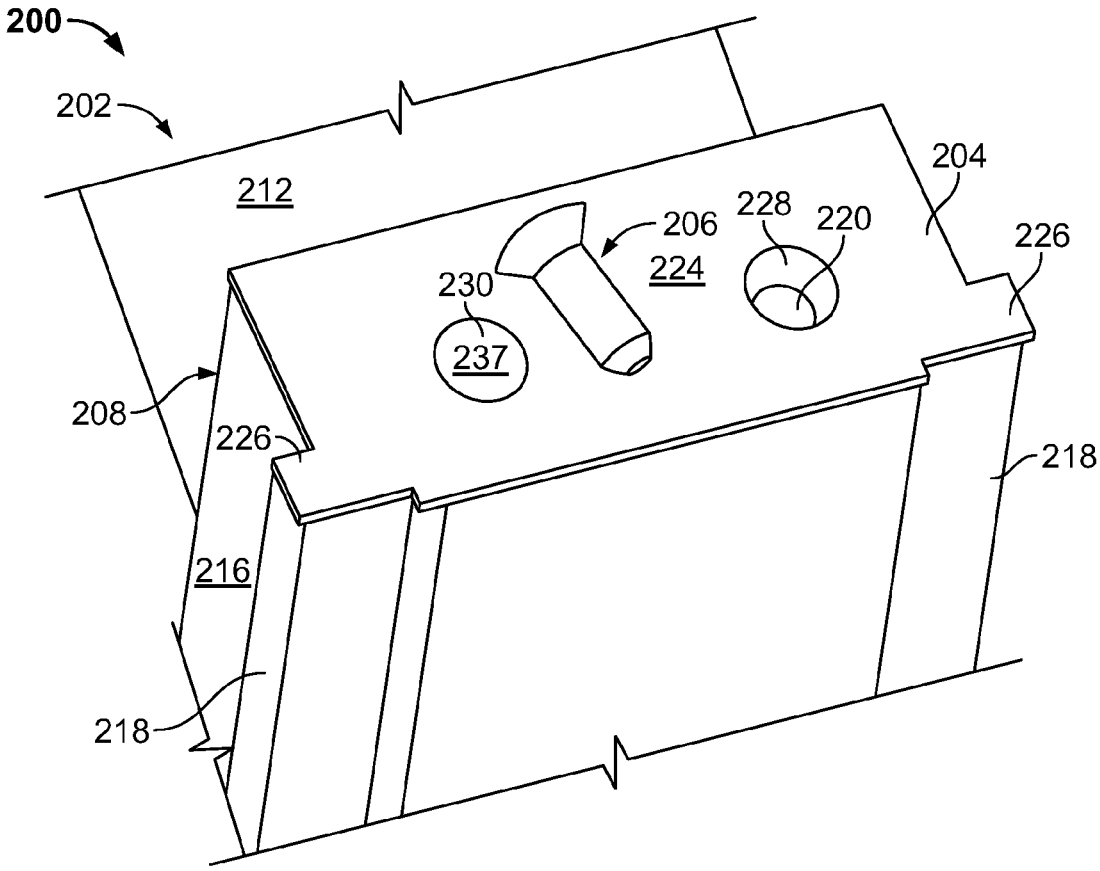
FIG. 7 is a perspective view of an alternative embodiment of a blade assembly that may be used with the gas turbine engine shown in FIG. 1.
Figure 8:
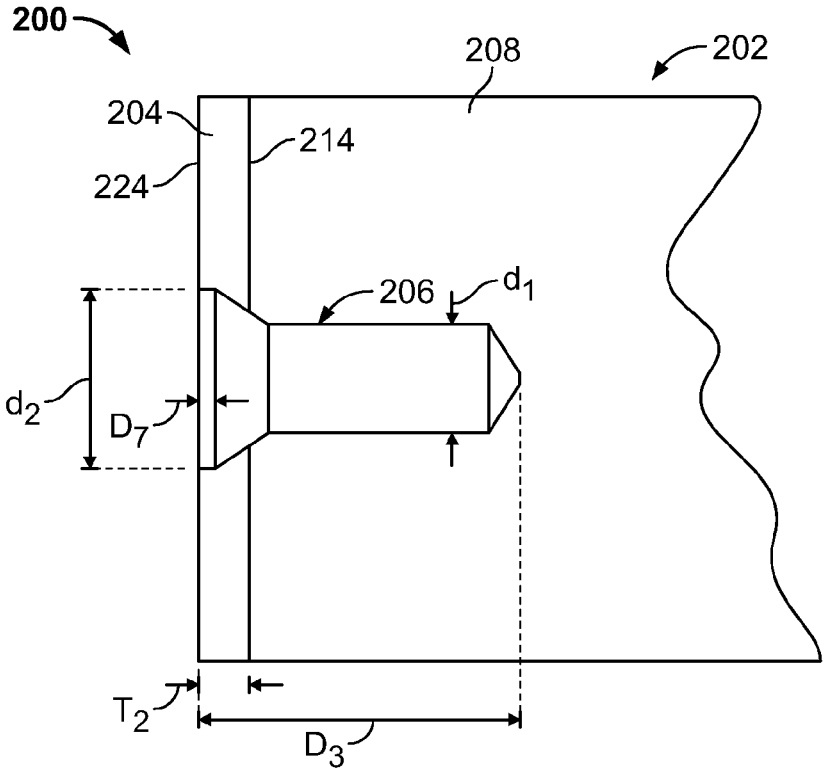
FIG. 8 is a cut-away side view of the blade assembly shown in FIG. 7.

FIG. 7 is a perspective view of blade assembly 200. FIG. 8 is a cut-away side view of blade assembly 200. To form blade assembly 200, blade 202, shim 204, and rivet 206 are coupled together. More specifically, base 208 and shim 204 are aligned such that hole 220 and aperture 228 may be drilled in a single drill pass such that the drill bit is not removed from shim aperture 228 to drill blade hole 220. Alternatively, hole 220 and aperture 228 may be formed is separate drill passes. Drilling aperture 228 and hole 220 in a single drill pass facilitates increasing aperture 228 and hole 220 alignment in comparison to drilling aperture 228 and hole 200 in multiple drill passes, such as, drilling aperture 228, removing the drill bit from aperture 228, and drilling hole 220. A hand drill, a drill press, or any other suitable drilling apparatus may be used to form aperture 228 and hole 220. In the exemplary embodiment, a center drill is used to form aperture 228 and hole 220. Alternatively, other types of drill bits may be used. To facilitate creating an interference fit between rivet 206 and hole 220, rivet knurls 240 may be measured and aperture 228 and hole 220 may be re-drilled to an appropriate size for knurls 240, if needed.

In the exemplary embodiment, rivet 206 is then forced through aperture 228 and into hole 220 such that shim 204 is coupled to blade 202. Shim 204 is secured to blade 202 via the interference fitting of rivet 206 in hole 220. Once shim 204 is secured to blade 202, a second aperture 228 and a second hole 220 may be drilled. Alternatively, a plurality of holes 220 and a plurality of apertures 228 may be formed before shim 204 is secured to blade 202. Another rivet 206 is inserted through the second aperture 228 and into the second hole 220. In the exemplary embodiment, each rivet 206 is counter-sunk into aperture 228 at a depth $D_7$. Alternatively, rivet head 230 remains substantially flush with shim end face 224. In the exemplary embodiment, any rivet material that is elevated above shim end face 224 is removed.

Once blade assembly 200 is formed, blade assembly 200 is secured within casing channel 142 with other blades 130 to form a row of blades 130 and 202. In the exemplary embodiment, the row of blades 130 and 202 are positioned within compressor 102. Blade assembly 200 facilitates reducing gaps between blades 130 and 202 such that movements of blades 130 and 202 within casing 116 are facilitated to be reduced. Furthermore, each rivet 206 facilitates retaining each shim 204 within channel 142 by securing each shim 204 to blade 202. Because shims 204 are more tightly secured within casing 116, shims 204 are less likely to move into flow path 118 and disrupt fluid flowing therethrough, and/or are less likely to fall into compressor 102 and damage compressor components. Furthermore, because shim 204 facilitated to be more securely coupled within casing 116, shim thickness $T_2$ remains substantially constant because rubbing between blades 130 and 202 against shim 204 is facilitated to be reduced. Moreover, because shim thickness $T_2$ remains substantially constant during the life of turbine engine 100, a gap or clearance between blades 130 and 202 is facilitated to remain decreased in comparison to other known blade assemblies having a shim. As a result, blade movements are facilitated to be reduced in comparison with other known blade assemblies that include a shim.

The above-described apparatus facilitates increasing turbine efficiency and power output by facilitating securing shims in position out of a flow path. The blade assembly secures shims within the casing, such that fluid disturbance by shims is facilitated to be reduced in comparison to other known blade assemblies having a shim. Furthermore, when a shim falls into the compressor, the shim may cause damage to the compressor components, but the blade assembly facilitates securing shims within the casing such that the possibility of a shim falling into the compressor is facilitated to be reduced in comparison to other known blade assemblies having a shim. Furthermore, wear on the blades and the shim is facilitated to be reduced in comparison to other known blade assemblies having a shim because the shim is secured to a blade. With shim wear facilitated to be reduced, the shim and/or blade are not required to be replaced as often. Because the top of the rivet is counter-sunk or flush to the shim face, the possibility of wear on the rivet is facilitated to be reduced as is the possibility of the rivet coming loose. Because it is less likely that the rivet will come loose, the turbine noise from rattling is facilitated to be reduced and the possibility that the shim will disturb the flow path is also facilitated to be reduced in comparison to other known blade assemblies having a shim.

Exemplary embodiments of a method and apparatus to facilitate securing a shim in position within a turbine casing are described above in detail. The apparatus is not limited to the specific embodiments described herein, but rather, components of the method and apparatus may be utilized independently and separately from other components described herein. For example, the blade assembly may also be used in combination with other turbine engine components, and is not limited to practice with only gas turbine engine compressors as described herein. Rather, the present invention can be implemented and utilized in connection with many other shim security applications.

While the invention has been described in terms of various specific embodiments, those skilled in the art will recognize that the invention can be practiced with modification within the spirit and scope of the claims.

What is claimed is:

1. A method for assembling a stator assembly for a turbine engine, said method comprising:

providing a blade having a base including an end wall having at least one hole defined therein;

providing a shim having at least one aperture extending therethrough;

aligning the at least one shim aperture with the at least one end wall hole;

securing the shim to the blade base end wall using a fastener inserted through the at least one shim aperture in an interference fit within the at least one end wall hole;

inserting the fastener through the shim and the blade base such that an outer surface of an end of the fastener is at least one of flush with an outer surface of the shim and countersunk within the at least one shim aperture, when the shim is secured to the blade base; and coupling the blade and the shim to a turbine casing.

2. A method in accordance with claim 1 wherein securing the shim to the blade base end wall using a fastener comprises securing the shim to the blade base end wall using a rivet including collapsible knurls formed on the rivet.

3. A method in accordance with claim 1 wherein securing the shim to the blade base end wall using a fastener comprises securing the shim to the blade base end wall using a rivet including a tapered head portion.

4. A method in accordance with claim 1 further comprising forming the at least one end wall hole and the at least one shim aperture during a single drill pass.

5. A method in accordance with claim 1 wherein securing the shim to the blade base end wall further comprises securing the shim between a pair of adjacent blades such that the shim is secured to the base of one of the blades.

6. A method in accordance with claim 1 further comprising securing the blade and the shim in a retaining groove defined in a turbine casing using flanges defined on at least one of blade base and the shim.

7. A gas turbine engine comprising:

a compressor; and a stator assembly comprising:

a blade comprising a base comprising at least one hole defined therein;

a shim comprising at least one aperture extending therethrough; and a fastener configured to secure said shim to said blade base such that said at least one aperture is substantially concentrically aligned with said at least one base hole, said fastener is inserted through said at least one shim aperture and is interference fit in said at least one base hole, said fastener comprising an outer surface that is one of flush with an outer surface of said shim and is countersunk within said at least one shim aperture, when said shim is secured to said blade base.

8. A gas turbine engine in accordance with claim 7 wherein said fastener comprises collapsible knurls extending outward therefrom.

9. A gas turbine engine in accordance with claim 7 wherein said fastener comprises a tapered head portion.

10. A gas turbine engine in accordance with claim 7 further comprising a plurality of blades, said shim is coupled between a pair of adjacent blades and is secured against one of said plurality of blades.

11. A gas turbine engine in accordance with claim 7 wherein said base comprises at least one flange extending outward therefrom, said shim comprises at least one flange extending outward therefrom, said at least one blade flange and said at least one shim flange are configured to retain said blade and said shim in a retaining groove defined in a turbine casing.

12. A blade assembly for use with a turbine engine, said blade assembly comprising:

a base comprising an end wall, at least one hole is defined in said end wall;

a shim comprising at least one aperture defined therethrough, said at least one aperture is substantially aligned with said at least one end wall hole; and a rivet inserted through said at least one shim aperture and interference fit in said at least one end wall hole, said rivet comprising a head portion comprising an outer surface that is one of flush with an outer surface of said shim and is countersunk within at least one shim aperture, when said shim is secured to said base.

13. A blade assembly in accordance with claim 12 wherein said rivet comprises collapsible knurls extending outward therefrom.

14. A blade assembly in accordance with claim 12 wherein said rivet comprises a tapered head portion.

15. A blade assembly in accordance with claim 12 wherein said at least one end wall hole and at least one shim aperture are formed during a single drill pass.

16. A blade assembly in accordance with claim 12 wherein said shim is coupled between a pair of adjacent blades and is secured against one of said blades.

17. A blade assembly in accordance with claim 12 comprising at least one flange extending outward from said base and at least one flange extending outward from said shim, such that said at least one base flange and said at least one shim flange retain said blade assembly in a retaining groove defined in a turbine casing.

* * * * *